United States Patent [19]

Nielsen, Jr.

[11] 4,391,110

[45] Jul. 5, 1983

[54] BARREL LOCK SLEEVE

[75] Inventor: Anker J. Nielsen, Jr., Holden, Mass.

[73] Assignee: Omco Inc., Holden, Mass.

[21] Appl. No.: 288,189

[22] Filed: Jul. 29, 1981

[51] Int. Cl.[3] ..... E05B 17/14; E05B 67/36

[52] U.S. Cl. ..... 70/34; 70/428

[58] Field of Search ..... 70/32, 33, 34, 27, 386, 70/423, 424, 425, 426, 427, 428

[56] References Cited

U.S. PATENT DOCUMENTS

| | | | |
|---|---|---|---|
| 1,867,361 | 7/1932 | Keil | 70/428 |
| 2,561,029 | 7/1951 | Mason | 70/428 |

FOREIGN PATENT DOCUMENTS

| | | | |
|---|---|---|---|
| 279290 | 10/1914 | Fed. Rep. of Germany | 70/33 |
| 440439 | 10/1948 | Italy | 70/33 |
| 474653 | 8/1969 | Switzerland | 70/34 |

*Primary Examiner*—Robert L. Wolfe

*Attorney, Agent, or Firm*—Thompson, Birch, Gauthier & Samuels

[57] ABSTRACT

A barrel lock sleeve for snap-mounting in a keyway aperture of a door for use in lockably blocking the keyway for security purposes. The sleeve is fixed in the door aperture by the insertion and locking of a conventional barrel lock within the sleeve. The sleeve includes means for permitting the outside diameter of a forward portion of the sleeve to be resiliently compressed so that the sleeve can be snapped into the door aperture.

7 Claims, 5 Drawing Figures

BARREL LOCK SLEEVE

BACKGROUND OF THE INVENTION

Between approximately 1930 and 1970, an Eastern public utility company installed a large number of electric meters. Many of these meters were and are still enclosed in a specific type of meter box which is commonly known as a Murray enclosure. Murray enclosures were made by Murray Manufacturing Company of Brooklyn, N.Y. A Murray enclosure has a front door which is locked closed by an interior locking mechanism known as a Metropolitan Lock.

In order to unlock the front door of the Murray enclosure, it is necessary to insert a controlled distribution, relatively large diameter, expanding key through an aperture formed in the Murray enclosure door. However, to discourage unauthorized persons from opening the Murray enclosure and tampering with the electric meter, the Murray enclosure was fitted with a glass window in the door aperture. The glass window is permanently mounted in the door aperture so that the glass window must be broken before the expanding key can be inserted. Therefore, although the glass window does not physically prevent an unauthorized person from breaking the window and opening the Murray enclosure with a pick or other burglar's tool, the broken glass does create a clear signal to the utility's inspectors that someone has tampered with the electric meter.

Not only does the glass window fail to physically prevent a thief from breaking the window and opening the Murray enclosure, but the utility's own meter installers and repairmen also must break the glass window in order to open the Murray enclosure for authorized purposes. This means that it is necessary to break the glass every time an authorized box entry is required. The resulting broken glass is dangerous and messy.

Therefore, it is an object of this invention to plug or block the keyway entrance in the door of a Murray enclosure by providing a reusable device which does not utilize glass, is not messy, and is not dangerous.

It is also an object of this invention to plug or block the Murray enclosure door aperture with a security device that physically bars the passage of an unauthorized person's pick or tools. In other words, instead of a glass window which can be easily broken by anyone, it is an object of this invention to provide a lockable plug which can be removed only by an authorized person.

SUMMARY OF THE INVENTION

In order to achieve the objects of this invention, applicant has provided a barrel lock sleeve which is adapted to be pushed into and resiliently snap-mounted in a meter box door aperture. The sleeve is sized and shaped so that it can then be securely fixed within the door aperture by a conventional barrel lock which is inserted into and locked within the sleeve.

The sleeve is a hollow cylinder and has open leading and trailing ends. The sleeve has four axially sequential, but not necessarily contiguous, portions. The four portions are a tip portion, a locking ball retaining portion, a neck portion and a shoulder portion. The tip portion and the locking ball retaining portion are both sized and shaped so that they can be inserted through the meter box door aperture and positioned on the inside of the door. The neck portion is sized and shaped so that it can be positioned within the door aperture. The shoulder portion is sized and shaped so that it can be positioned on the outside of the door.

The tip portion is located at the extreme leading end of the sleeve and has an outside diameter at the tip which is smaller than the door aperture diameter so that the tip portion can be easily inserted through the door aperture. The locking ball retaining portion is located behind the tip portion and has at least a portion of its outside diameter larger than the door aperture diameter. The locking ball retaining portion includes means, such as longitudinal slots, for permitting its maximum outside diameter portion to be resiliently and sufficiently reduced in diameter as said maximum diameter portion is pushed through the door aperture. The means also permits the maximum outside diameter portion to snap back to its original uncompressed outside diameter size after the locking ball retaining portion has been inserted through and clears the door aperture and is entirely positioned within the meter box interior.

The neck portion is located behind the locking ball retaining portion and has an outside diameter which is smaller than the door aperture diameter. This permits the neck portion to be positioned within the door aperture.

The shoulder portion is located behind the neck portion and has at least a portion of its outside diameter which is larger than the door aperture diameter. The shoulder portion has an inside diameter which is larger than the diameter of the head of a conventional barrel lock.

The barrel lock sleeve has an interior length, shape and inside diameter which is selected to permit an unlocked barrel lock to be inserted entirely into the sleeve. The sleeve also accommodates the radial extension of the barrel lock locking balls within the locking ball retaining portion when the barrel lock is locked. Therefore, when the barrel lock is locked, the sleeve is fixed in the meter box door aperture. When the barrel lock is unlocked, the barrel lock can be removed from the sleeve and the sleeve can be snapped out of the door aperture. Then, an authorized Metropolitan lock key can be inserted through the door aperture to open the front door of the Murray enclosure.

DESCRIPTION OF THE PREFERRED EMBODIMENT

Figure 1:
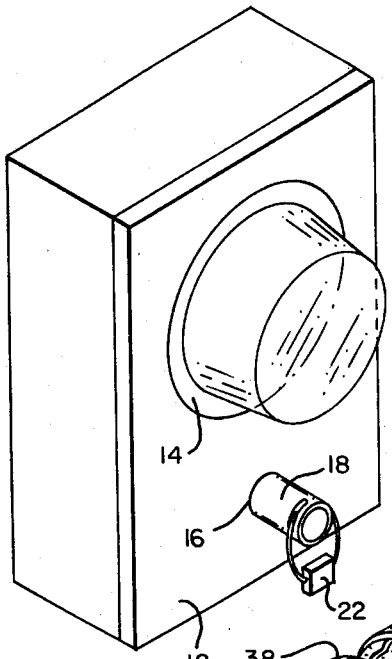
FIG. 1 is a perspective view of the electric meter box enclosure showing the barrel lock sleeve mounted and locked in the meter box door aperture.

FIG. 1 shows a Murray enclosure which is an electric meter box 10. This type of a box was manufactured by Murray Manufacturing Company of Brooklyn, N.Y. from approximately 1930 to 1970. Box 10 is a hollow rectangular box with a front door 12 in which is formed a glass bowl opening 14 through which the glass bowl-enclosed meter can be read.

Front door 12 is locked by an unshown Metropolitan locking mechanism that is mounted on the inside of the front door. In order for an authorized person to lock or unlock the door, an unshown special key is used. The key is inserted through a circular door aperture 16 which is approximately 0.590 inches in diameter. In order to discourage unauthorized persons from trying to pick the Metropolitan lock, it has been the customary practice to mount a glass window permanently within door aperture 16. Thus, if a thief tried to pick the lock, he would have to first break the glass window. Unfortunately, an authorized repairman or installer would also have to first break the glass window in order to unlock the door.

In the present invention, the glass window has been eliminated and a barrel lock sleeve 18 has been snap-mounted within door aperture 16. To hold the barrel lock sleeve in place within the door aperture and to prevent unauthorized access to the interior locking mechanism, a conventional barrel lock 20 is inserted entirely within barrel lock sleeve 18 and the barrel lock is locked. As a further precaution, a conventional seal 22 (sometimes called a tell-tale) is threaded through slots 24 formed near the trailing end of the barrel lock sleeve. It is necessary to break the seal before unlocking the barrel lock 20.

Figure 2:
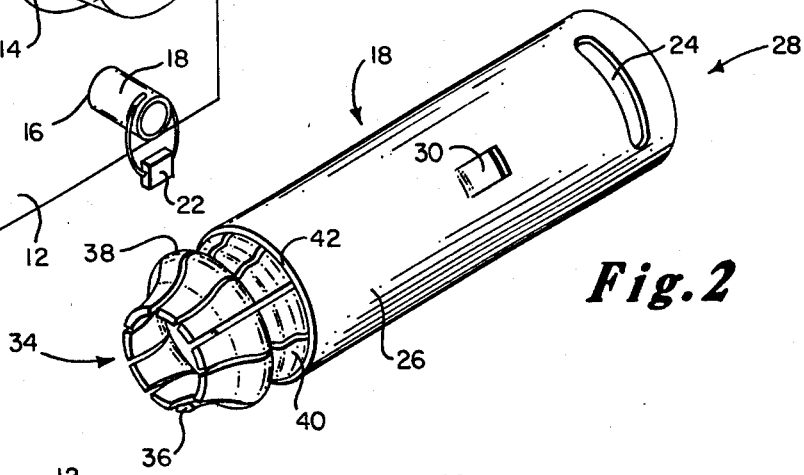
FIG. 2 is a view in perspective of the barrel lock sleeve.
Figure 3:
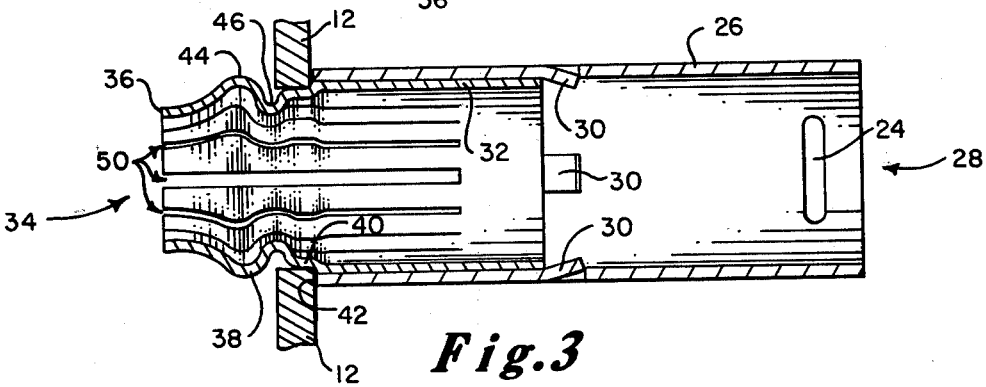
FIG. 3 is a sectional view of the barrel lock sleeve taken on line 3—3 of FIG. 5.
Figure 5:
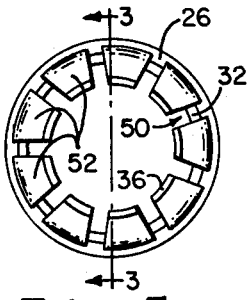
FIG. 5 is an end elevational view of the barrel lock sleeve which is shown in FIG. 3.
Figure 4:
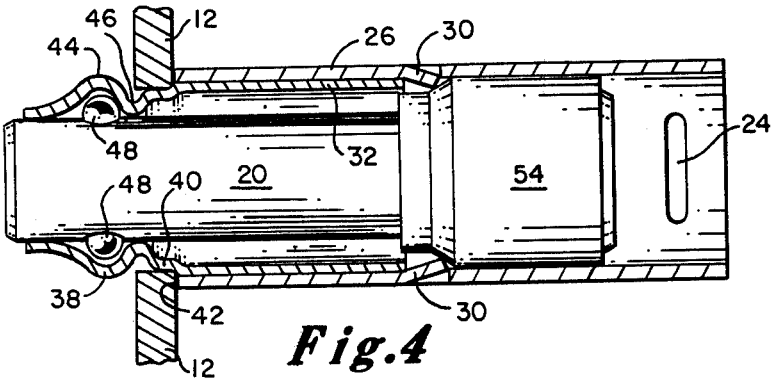
FIG. 4 is a similar sectional view of the barrel lock sleeve with the barrel lock shown locked within the sleeve.

Referring now to FIGS. 2, 3 and 5, it will be seen that sleeve 18 is sized, shaped and adapted to be pushed into door aperture 16 and to be snap-mounted therein. That is, door aperture 16 is approximately 0.590 inches in diameter in order to accommodate the special key which is necessary to open the Metropolitan lock which is on the interior of the meter box 10. Sleeve 18 is sized and shaped so that a portion of its outer diameter can be momentarily resiliently reduced as it passes through door aperture 16 whereby uncompressed portions of the sleeve on the inside of the box and portions of the sleeve on the outside of the box will both have outer diameters larger than the door aperture. Thus, the sleeve will remain snugly mounted within the door aperture after being resiliently snap-mounted therein.

Barrel lock sleeve 18 will now be described in detail. Sleeve 18 can be a single cylinder or, as shown in the drawings, can be a telescoped pair of cylinders which are bonded together. The preferred embodiment of sleeve 18 has an outer cylinder 26 which forms the trailing end 28 of the sleeve. The two slots 24 are formed near the trailing end 28 of the sleeve.

Outer cylinder 26 has been satisfactorily formed from 1010 steel material which has been heat treated and case hardened. Outer cylinder 26 preferably has a wall thickness of 0.048 inches and can be made with a longitudinal dovetailed seam, or with a welded seam, or drilled out of solid material, or drawn, or extruded. Preferably, the inner diameter of outer cylinder 26 is 0.625 inches and the outer diameter is 0.721 inches. Four inwardly upset tabs 30 are spaced 90 degrees apart and act as stops for the barrel lock head.

The inner cylinder 32 is made of the same steel material, but has thinner walls, preferably 0.030 inches in thickness. The inner cylinder is telescoped within the outer cylinder and is bonded thereto as by four spot welds which are spaced 90 degrees apart.

It will be appreciated that sleeve 18 can be a single cylinder or, as shown, a pair of telescoped cylinders. In the shown preferred embodiment, inner cylinder 32 has an open leading end 34.

Sleeve 18 has four axially sequential, although not necessarily contiguous, portions running from the leading end 34 towards the trailing end 28. These four portions consist of a tip portion 36, a locking ball retaining portion 38, a neck portion 40, and a shoulder portion 42. The tip portion 36 is located at the extreme leading end 34 of the sleeve and has an uncompressed outside diameter which is smaller than the door aperture diameter. The tip portion 36 is shaped and sized so that it can be easily inserted into door aperture 16.

Locking ball retaining portion 38 is located to the rear of tip portion 36 and has an undulating shape, somewhat like an hourglass, including a maximum outside diameter portion 44 and a minimum outside diameter portion 46. The diameter of the maximum outside diameter portion is larger than the diameter of the door aperture 16 and has an interior curvature shaped to accommodate the extended locking balls 48 of the barrel lock 20.

The tip portion 36 and the locking ball retaining portion 38 are both intended to be positioned inside the meter box door 12 when the sleeve 18 is snap-mounted in the meter box door aperture 16.

The locking ball retaining portion 38 includes means for permitting its maximum outside diameter portion 44 to be resiliently and adequately reduced in diameter as the locking ball retaining portion 38 is pushed through the door aperture 16, and for permitting the maximum outside diameter portion 44 to snap back to its original uncompressed maximum outside diameter size after the locking ball retaining portion has cleared the door aperture and passed into the interior of the meter box 10. Preferably, this means for permitting the reduction of the maximum outside diameter portion 44 consists of a plurality of circumferentially spaced-apart, longitudinally extending slots 50 running from the tip portion 36 through locking ball retaining portion 38. However, it should be understood that the tip portion itself, because of its relatively small uncompressed outside diameter, does not need to be provided with any independent means for permitting diametrical reduction.

The neck portion 40 is located to the rear of the locking ball retaining portion 38 and has an outside diameter which is no greater than the diameter of the door aperture 16. Preferably, it is just slightly smaller than the door aperture diameter to provide a snug fit therein.

Finally, shoulder portion 42 is located to the rear of the neck portion and has at least a portion of its outside diameter which is larger than the door aperture diameter. It is intended that the neck portion 40 will seat within the door aperture itself and the shoulder portion 42 will abut the outside of front door 12 around the door aperture preventing the sleeve from passing inwardly through the door aperture.

As can be seen in FIG. 5, the tip portion 36 has a plurality of resilient tip elements 52 which are formed by the slots 50. The tip portion 36 and the leading portion of the locking ball retaining portion 38 are substantially shaped as a truncated cone and each of the tip elements 52 becomes narrower in a tapered fashion in the direction of the leading end 34.

In order to even more clearly understand the construction and functioning of barrel lock sleeve 18, its operation will now be described in detail. Once the glass window has been removed from door aperture 16, sleeve 18 is snap-mounted within the door aperture by inserting the tip portion 36 into the door aperture. The relatively small diameter tip portion 36 easily fits into and passes through door aperture 16. As the sleeve is pushed axially through the aperture, the maximum outside diameter portion 44 of locking ball retaining portion 38 contacts the door aperture. Continued axial pressure on the sleeve causes the locking ball retaining portion to momentarily resiliently reduce in diameter because of the reduction in width of slots 50 until the locking ball retaining portion 38 passes entirely through door aperture 16. Then, both the tip portion and the locking ball retaining portion are positioned on the inside of the meter box front door 12. In this position, neck portion 40 seats snugly within the door aperture 16 and the shoulder portion 42 abuts against the outside surface of the door 12 forming a stop by which barrel lock sleeve 18 is prevented from further axial movement towards the meter box interior. After the locking ball retaining portion has cleared the door aperture, its maximum outside diameter portion 44 snaps back and regains its original uncompressed diameter which is larger than the door aperture diameter. Thus, the barrel lock sleeve is snugly snap-mounted within the door aperture.

In order to lock the sleeve within the door aperture, a conventional barrel lock 20 is inserted entirely into sleeve 18. Conventional barrel locks are completely described in U.S. Pat. Nos. 3,714,802 and 3,835,674. The disclosures of those patents are incorporated herein by reference. The inward axial movement of head 54 of the barrel lock 20 is stopped by centrally extending tabs 30 which axially locate the barrel lock so that its locking balls are positioned within the locking ball retaining portion 38. The barrel lock is inserted in an unlocked condition in which the two locking balls 48 are relaxed and recessed flush with the barrel lock exterior surface. Then, when the barrel lock is locked by its key, locking balls 48 extend radially and snugly fit within locking ball retaining portions 38.

After the barrel lock is locked, a seal 22 is applied in slots 26 as a further precaution. In this condition, if an unauthorized person attempts to pull the barrel lock sleeve from the door aperture, the locking balls within locking ball retaining portion 38 will prevent outward passage of the barrel lock sleeve. Likewise, it is not possible to drive the barrel lock sleeve into the meter box because of the presence of shoulder portion 42. Of course, the barrel lock is virtually impossible to pick and the barrel lock keys are carefully controlled in their distribution.

Thus, the barrel lock sleeve of this invention forms a reusable keyhole plug which physically bars entry through the keyhole by unauthorized persons, which cannot be removed by unauthorized persons, and which does not create a dangerous mess as did the glass windows which this invention replaces.

The above description obviously suggests many possible variations and modifications of this invention which would not depart from its spirit and scope. It should be understood, therefore, that the invention is not limited in its application to the details of structures specifically described or illustrated and that, within the scope of the appended claims, it may be practiced otherwise than as specifically described or illustrated.

I claim:

1. A barrel lock sleeve adapted to be pushed into and resiliently snap-mounted in a meter box door aperture, said sleeve adapted to be fixed in the door aperture by a barrel lock inserted and locked within said sleeve, said sleeve comprising:

(a) a hollow cylindrical sleeve having open leading and trailing ends;

(b) said sleeve having four axially sequential portions including a tip portion and a locking ball retaining portion both adapted to be inserted through the door aperture and positioned on the inside of the door, a neck portion adapted to be positioned within the door aperture, and a shoulder portion adapted to be positioned on the outside of the door;

(c) said tip portion being located at the extreme leading end of said sleeve and having an uncompressed outside diameter smaller than the door aperture diameter;

(d) said locking ball retaining portion being located to the rear of said tip portion and having at least a portion of its uncompressed outside diameter larger than the door aperture diameter, said locking ball retaining portion including means for permitting said larger outside diameter portion of said locking ball retaining portion to be resiliently and sufficiently reduced in diameter as said larger portion is pushed through the door aperture, and for permitting said larger outside diameter portion of said locking ball retaining portion to snap back to its original uncompressed outside diameter after said larger portion has passed to the inside of the meter box door;

(e) said neck portion being located to the rear of said locking ball retaining portion, and having an outside diameter smaller than the door aperture diameter;

(f) said shoulder portion being located to the rear of said neck portion and having at least a portion of its outside diameter larger than the door aperture diameter and having an inside diameter larger than the barrel lock head diameter; and (g) said sleeve having an interior length, shape and inside diameter selected to permit the insertion of an unlocked barrel lock entirely therein, and to accommodate the radial extension of the barrel lock locking balls within said locking ball retaining portion when said barrel lock is locked, said sleeve being sized and shaped to remain fixed in the meter box door aperture when the barrel lock is locked, and to be removed from the door aperture when the barrel lock is unlocked.

2. The sleeve of claim 1 wherein said locking ball retaining portion diameter reduction means includes a plurality of circumferentially spaced-apart, longitudinally extending slots formed therein.

3. The sleeve of claim 2 wherein said tip portion and said locking ball retaining portion have a plurality of circumferentially spaced-apart, longitudinally extending contiguous slots formed therein, said slotted leading end forming a plurality of tip elements.

4. The sleeve of claim 1 wherein said tip portion is substantially shaped as a truncated cone.

5. The sleeve of claim 1 wherein said shoulder portion has interior stop means for blocking the axial passage of the barrel lock head towards said leading end of said sleeve.

6. The sleeve of claim 1 wherein said leading end and said trailing end are formed by two separate metal cylinders, said cylinders being telescoped and bonded together, said leading end cylinder walls being relatively thinner and more resilient than said trailing end cylinder walls.

7. The sleeve of claim 6 wherein said leading end cylinder is telescoped within said trailing end cylinder.

* * * * *